United States Patent [19]

Murai et al.

[11] Patent Number: 4,519,695

[45] Date of Patent: May 28, 1985

[54] IMAGE DENSITY CONTROL METHOD FOR ELECTROPHOTOGRAPHY

[75] Inventors: Kazuo Murai; Yutaka Hasegawa, both of Tokyo, Japan

[73] Assignee: Ricoh Company, Ltd., Tokyo, Japan

[21] Appl. No.: 464,455

[22] Filed: Feb. 7, 1983

[30] Foreign Application Priority Data

Feb. 12, 1982 [JP] Japan ..... 57-20731

[51] Int. Cl.[3] ..... G03G 15/00

[52] U.S. Cl. ..... 355/14 R; 355/14 D; 355/14 CH; 355/77; 118/691

[58] Field of Search ..... 355/14 R, 14 D, 14 CH, 355/77, 14 E, 14 C; 118/679, 665, 689–691, 663, 664

[56] References Cited

U.S. PATENT DOCUMENTS

| | | | |
|---|---|---|---|
| 4,313,671 | 2/1982 | Kuru | 355/14 D |
| 4,318,610 | 3/1982 | Grace | 355/14 D |
| 4,341,461 | 7/1982 | Fantozzi | 355/14 D |
| 4,348,099 | 9/1982 | Fantozzi | 355/14 CH |
| 4,372,672 | 2/1983 | Pries | 355/14 D |

*Primary Examiner*—Richard L. Moses

*Attorney, Agent, or Firm*—David G. Alexander

[57] ABSTRACT

A method of controlling an image density in electrophotography by controlling at least one of various image density parameters in response to values detected from different pattern areas, the image density parameters including an amount of charge deposited on a photoconductive element by a charger, bias voltage for development, toner concentration in a developer, amount of toner supply to a developing unit and image transfer potential. The method forms at least two pattern areas having different potentials on the surface of the photoconductive element by at least one of various means for forming charge patterns which include controlling the energization of the charger, controlling an illumination lamp and projecting an image pattern. In different ranges respectively assigned to the two pattern areas, there is digitized at least one of values associated with an image density which include a surface potential of the pattern area before development, toner density of the pattern area after development, surface potential of the pattern area after development and image density of an area of a transferred image which corresponds to the pattern area. The digitized data of the different patterns are compared with each other.

4 Claims, 15 Drawing Figures

MICROPROCESSOR
38
P14
P15
P16
P10
P11
P12
P13
X2
X1
T1
P27
P26
P25
P24
P21
P20
T0
INT
DATA OUT
A/D
CLK
CS
C0
RS
EX2
EX1
A0
A1
A2A3D0A6C1
36
VCC1
VCC2
32
32a
32b
56
52
42
58
40
54
62
60
82
DRUM SYNC PULSE
START PULSE 1/10 COPIES

| |
|---|
| Fig. 4A |
| Fig. 4B |

| |
|---|
| Fig. 5a-1 |
| Fig. 5a-2 |
| Fig. 5a-3 |

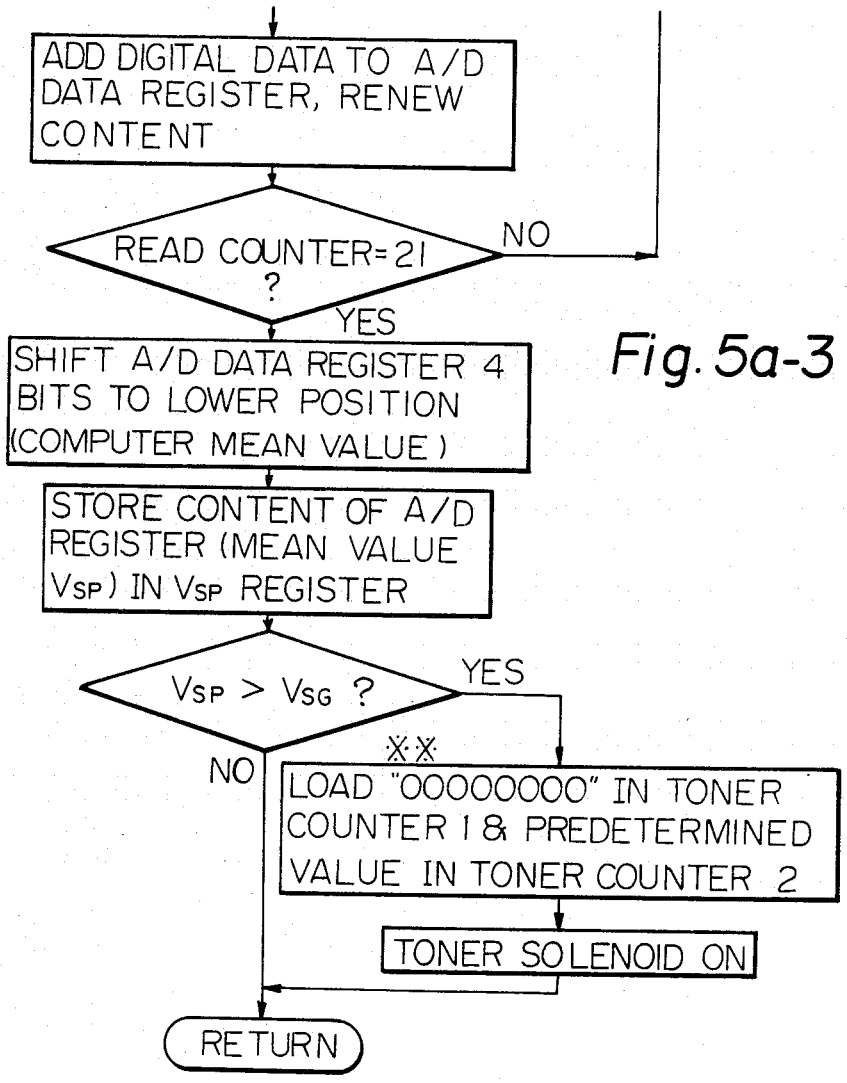
Fig. 5a-3
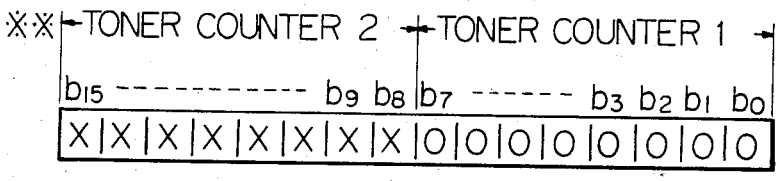

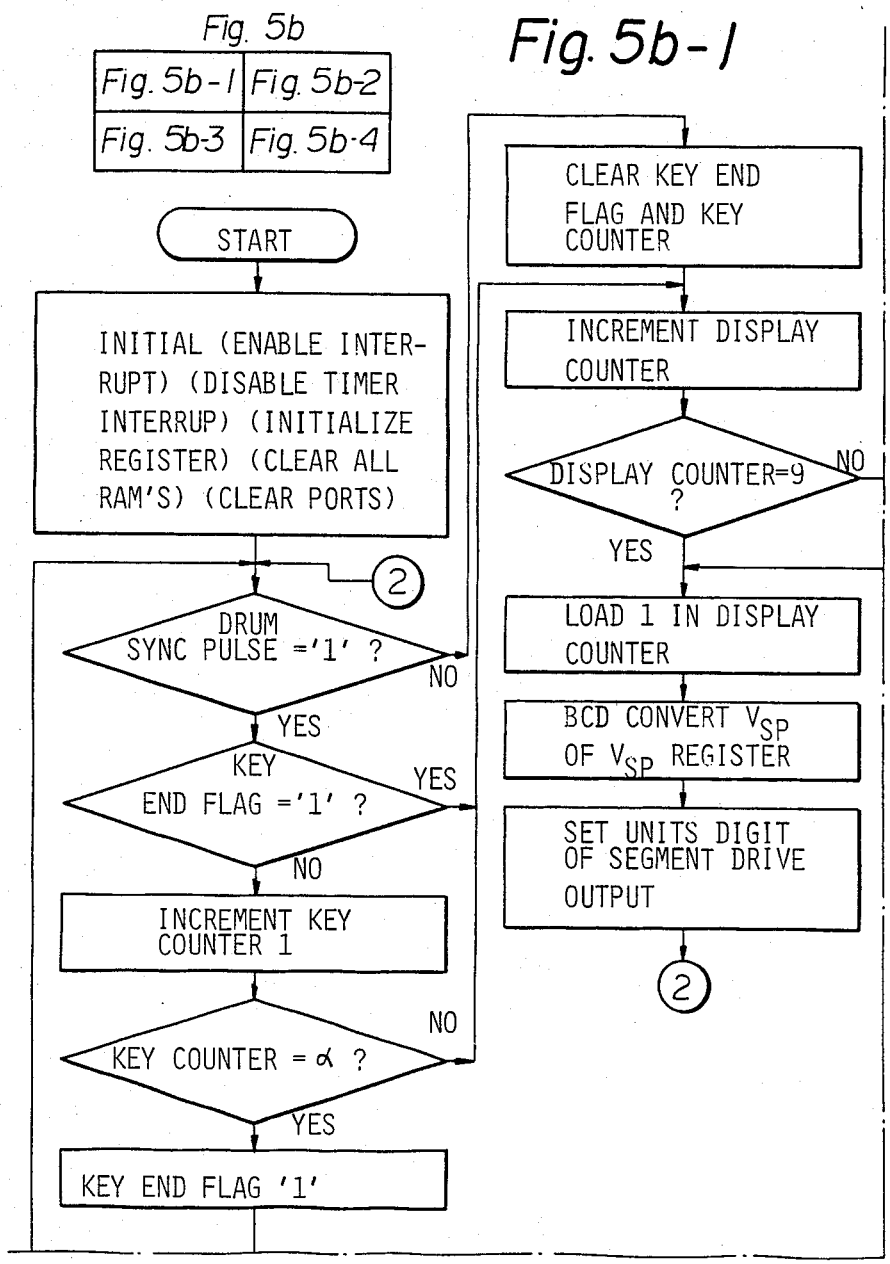
Fig. 5b
Fig. 5b-1
Fig. 5b-2
Fig. 5b-3
Fig. 5b-4
Fig. 5b-1
START
INITIAL (ENABLE INTERRUPT) (DISABLE TIMER INTERRUP) (INITIALIZE REGISTER) (CLEAR ALL RAM'S) (CLEAR PORTS)
2
DRUM SYNC PULSE ='1' ?
NO
YES
KEY END FLAG ='1' ?
YES
NO
INCREMENT KEY COUNTER 1
KEY COUNTER = α ?
NO
YES
KEY END FLAG '1'
CLEAR KEY END FLAG AND KEY COUNTER
INCREMENT DISPLAY COUNTER
DISPLAY COUNTER=9 ?
NO
YES
LOAD 1 IN DISPLAY COUNTER
BCD CONVERT $V_{SP}$ OF $V_{SP}$ REGISTER
SET UNITS DIGIT OF SEGMENT DRIVE OUTPUT
2

IMAGE DENSITY CONTROL METHOD FOR ELECTROPHOTOGRAPHY

BACKGROUND OF THE INVENTION

The present invention relates to a method of controlling the density of images reproduced by an electrophotographic process and, more particularly, to an image density control method which forms at least two test patterns on a photoconductive element which have greatly different latent image potentials, detects values associated with the image densities of the two patterns or of toner images corresponding to the two patterns, and controls an image density in response to the detected values.

In an electrophotographic or electrostatic recording apparatus, a latent image is formed electrostatically on a photoconductive element by a predetermined procedure and the latent image is developed by fine particles of colored toner supplied from a developing unit. Usually, the toner is charged to a polarity opposite to that of the latent image so that it may be electrostatically deposited on the latent image.

A method available for so charging a toner relative to a latent image employs a developer constituted by a toner and a carrier and stirs them together for frictional charging. This type of developer is usually referred to as a two-component developer. While the developing method using the two-component developer is capable of sufficiently charging a toner to a desired polarity, it requires adequate means for maintaining a constant toner concentration in the developer because only the toner is consumed by the development. It is therefore necessary to measure the varying toner concentration in the developer.

For the measurement of a toner concentration, a somewhat indirect method is known as disclosed in Japanese Patent Publication No. 16199/68. This method comprises the steps of forming a reference latent image pattern electrostatically on a photoconductive drum, developing the reference pattern and photoelectrically measuring the density of the developed image. In a direct method heretofore proposed, on the other hand, the weight or permeability of a developer is measured. Other known methods include one which controls a toner density by detecting a surface potential of a toner image on a photoconductive element (Japanese Patent Laid-Open Publication No. 92138/78). Various other methods have also been proposed for general image density control purpose such as one which controls the bias voltage for development in accordance with a difference in reflectivity between a reference density plate and an original document (Japanese Patent Laid-Open Publication No. 103736/78), one which controls the developing characteristics by detecting an image density during a copying cycle which uses a reference original document (Japanese Patent Laid-Open Publication No. 141645/79), and one which controls the amount of charge on a photoconductive element, bias voltage for development and/or illumination intensity by detecting an image density on an original document, latent image potential and toner image density (U.S. Pat. No. 2,956,487).

One of these known image density control methods employs light and dark patterns, such as black and white patterns, which are electrostatically formed on a photoconductive element. A problem has existed in this type of method in that where the black and white latent patterns on the photoconductive element are developed and the resulting toner densities of the two patterns are sensed by a photosensor, the toner tends to smear the surfaces of light emitting and light receiving elements which constitute the sensor in combination. This, coupled with the deterioration of the coactive elements, effects the input/output characteristics of the sensor so that errors are introduced into the result of measurement.

U.S. Pat. No. 4,082,445 discloses a method which measures a toner density while compensating for the variation in the characteristics of a light receiving element, surface of a photosensitive element and the like due, for example, to a change in the power source voltage, toner deposition, temperature variation and deterioration due to passage of time. In this prior art method, a non-image area on a photoconductive element where the toner is absent is photoelectrically detected first. Because the surface of a photoconductive element has a predetermined reflective power (reflectivity), periodic detection of such a non-image area is effective to see a change in the characteristics of the light receiving element. The change is compensated for by increasing the current which flows through the light emitting element, until the output of the light receiving element returns to a normal value. After the light receiving element has regained its normal density/output voltage characteristic, a density of a reference image is measured to control the toner density. This method, however, invites a disproportionate increase in cost due to the need for an additional circuit for increasing the current supply to the light emitting element. Moreover, the life of the light emitting element becomes shorter owing to the increased load acting thereon.

These drawbacks may be overcome by forming at least two test patterns on a photoconductive element, digitizing values associated with image densities of the test patterns by different resolutions, computing a ratio of the values associated with the image densities in terms of the digital data, and controlling various parameters related with the image densities in correspondence with the computed ratio, as disclosed in Japanese patent application No. 56-178891/81. The different resolutions assigned to the discrete patterns allow the values associated with the image densities to accurately represent the values of the discrete patterns, while the computation of a ratio equally weights the values associated with the respective image densities. Thus, the difference in resolution is equivalent to multiplication or division by a predetermined value. Various parameters related with image densities, therefore, accurately reflect the values associated with the image densities of the different patterns. Furthermore, any fluctuation in the values associated with the image densities attributable to a change in the characteristics of the sensor and photoconductive element appear proportionally in the different patterns, so that the control based on the ratio promotes a stable density control against the variation in characteristic.

Such a method as disclosed in Japanese patent application No. 56-178891/81 still involves a problem due to the use of a microprocessor for computing the ratio (division). As well known in the art, division by a microprocessor requires an intricate computing program and slows down the operation.

The present invention contemplates to omit the division to simplify the computing program although controlling the image density on the basis of the density ratio of at least two test patterns as in the prior art method discussed above. The simpler program will make the construction of a control device simpler and the processing faster.

Suppose that the image density parameter is a supplementary supply of toner, and that a white pattern on a photoconductive element has a developed image density (more strictly, its reciprocal) $V_{SG}$ while a black pattern has a developed image density (more strictly, its reciprocal) $V_{SP}$. Then, in a preferred embodiment, the toner supply is needless when the ratio $V_{SP}/V_{SG}$ is smaller than 4/1 due to a sufficient contrast, but necessary when otherwise due to an insufficient contrast. Employing such a threshold value (4/1) and, therefore, $V_{SP}=4V_{SG}$ from $V_{SP}/V_{SG}=4/1$, the density can be controlled such that the toner should be supplied when $V_{SP}\geqq 4V_{SG}$ due to a short contrast but not when $V_{SP}<4V_{SG}$ due to an adequate contrast. Thus, whether or not the toner supply is needed can be determined without resorting to division. Meanwhile, when analog signals $V_{SPa}$ and $V_{SGa}$ indicative of detected densities are respectively digitized at the ranges of 1:4, the digital data of $V_{SPa}$ represents $V_{SP}$ and the digital data of $V_{SGa}$, $4V_{SG}$. This permits whether or not to supply the toner to be determined merely by comparing the digital data of $V_{SPa}$ and $V_{SGa}$.

In light of this, the present invention selectively supplies a toner by converting analog data associated with black and white patterns into digital data each in a predetermined range which is different from the other. The ranges can be easily determined by dividing an input analog signal to an A/D converter by a resistance type potential divider.

SUMMARY OF THE INVENTION

It is therefore an object of the present invention to efficiently control the image density in electrophotography.

It is another object of the present invention to provide an image density control method for electrophotography which controls the image density on the basis of a ratio in image density between at least two test patterns formed on a photoconductive element.

It is another object of the present invention to provide an image density control method for electrophotography which quickly controls the image density by a simple control device and computation.

It is another object of the present invention to provide a generally improved image density control method for electrophotography.

A method of controlling an image density in electrophotography embodying the present invention controls at least one of various image density parameters in response to values detected from different pattern areas, the image density parameters including an amount of charge deposited on a photoconductive element by a charger, bias voltage for development, toner concentration in a developer, amount of toner supply to a developing unit and image transfer potential. The method forms at least two pattern areas having different potentials on the surface of the photoconductive element by at least one of various means for forming charge patterns which include controlling the energization of the charger, controlling an illumination lamp and projecting an image pattern. In different ranges respectively assigned to the two pattern areas, there is digitized at least one of values associated with an image density which includes a surface potential of the pattern area before development, toner density of the pattern area after development, surface potential of the pattern area after development and image density of an area of a transferred image which corresponds to the pattern area. The digitized data of the different patterns are compared with each other.

Other objects and features, together with the foregoing, are attained in the embodiments described in the following description and illustrated in the accompanying drawings.

BRIEF DESCRIPTION OF THE DRAWINGS

FIGS. 5*a*, 5*a*-1, 5*a*-2, 5*a*-3, are a flowchart demonstrating interrupt control of an image density control microprocessor;

FIGS. 5*b*, 5*b*-1, 5*b*-2, 5*b*-3, 5*b*-4 are a flowchart showing a main flow;

DESCRIPTION OF THE PREFERRED EMBODIMENTS

While the image density control method for electrophotography of the present invention is susceptible of numerous physical embodiments, depending upon the environment and requirements of use, substantial numbers of the herein shown and described embodiments have been made, tested and used, and all have performed in an eminently satisfactory manner.

Figure 1:
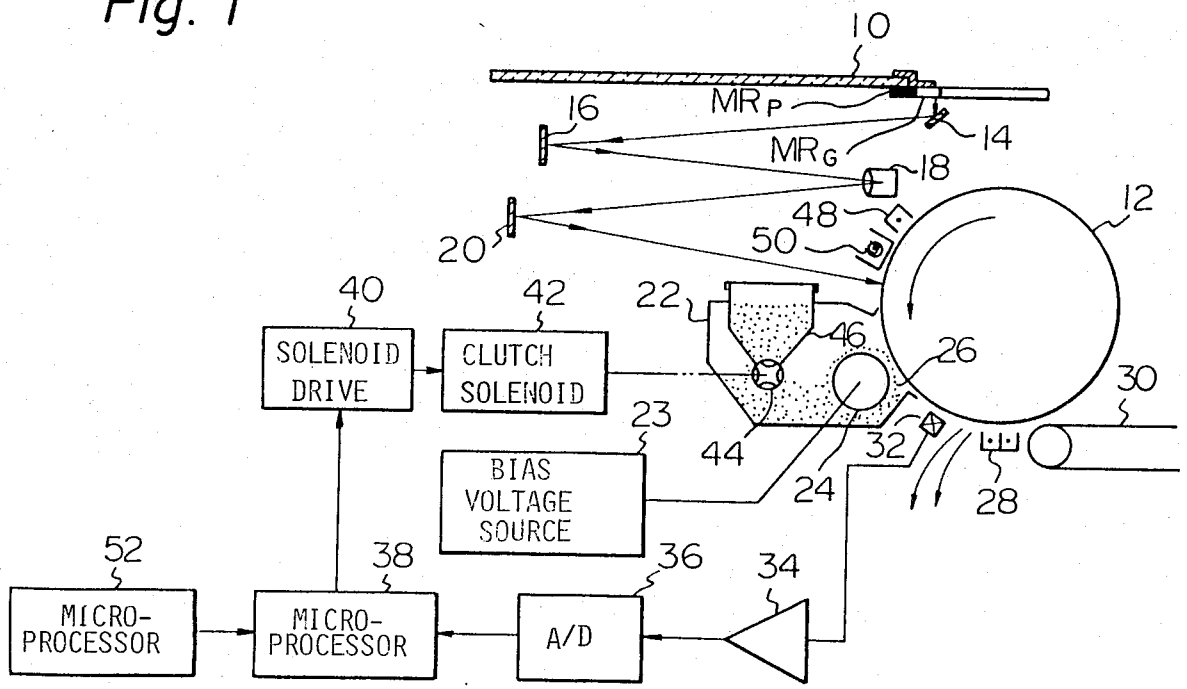
FIG. 1 is a schematic view of a copying machine furnished with a toner density control apparatus to which the present invention is applied.

Referring to FIG. 1 of the drawings, a copying machine to which the method of the present invention is applicable is shown. The copying machine includes a glass platen 10 on which an original document (not shown) is laid. Image light from the document is projected onto a photoconductive drum 12 by an imaging system which is made up of a first mirror 14, second mirror 16, in-mirror lens 18 and third mirror 20. The drum 12 is rotated counterclockwise as indicated by an arrow while the first and second mirrors 14 and 16 are moved to the left in synchronism with the rotation of the drum 12 and at a predetermined velocity ratio thereto. A latent image electrostatically formed on the drum 12 is developed by a developer 26 which is supplied by a developing roller 24 of a developing unit. The resulting toner image on the drum 12 is transferred onto a sheet of paper (not shown) by a transfer charger 28. The sheet carrying the toner image thereon is fed to a fixing station by a belt 30.

To practice the method of the present invention in such a copier, a white optical mark $MR_G$ is carried by an edge portion of the glass platen 10 in an image projection field and in a position corresponding to a home position of the first mirror 14. A black optical mark $MR_P$ is also carried by the glass platen 10 to the left of the white optical mark $MR_G$. As the first mirror 14 strokes to the left for scanning the document on the glass platen 10, patterns $P_G$ and $P_P$ of the white and black marks are electrostatically and successively formed on the drum 12 as latent images. A photosensor 32 is located between the developing unit (roller 24) and the transfer charger 28 to sense a toner density on the surface of the drum 12. The output signal of the photosensor 32 is fed to an amplifier 34 to be amplified and wave-shaped thereby. The output of the amplifier 34 is coupled to an analog-to-digital or A/D converter 36 and the digital output of the latter is fed to a microprocessor 38. The microprocessor 38 computes the density ratio between the toner image (toner image pattern) corresponding to the white pattern $P_G$ and that corresponding to the black pattern $P_P$, thereby determining an amount of toner to be supplied to the developing roller 24. For a period of time matching with the specific amount of toner supply, the microprocessor 38 supplies a solenoid driver 40 with a solenoid drive command so that the driver 40 energizes a clutch solenoid 42 for the duration of the solenoid drive command. Upon the energization of the solenoid 42, a roller 44 associated with a hopper 46 is coupled to a drive system for the drum 12 and thereby rotated to supply the desired amount of toner from the hopper 46.

In FIG. 1, also arranged around the drum 12 are a main charger 48 for uniformly charging the drum surface, and an erase lamp 50 for removing the charge from those areas of the drum surface just ahead and past of the image and outside a sheet size. A second microprocessor 52 is included in the illustrated copier to control copying operations other than the toner supply performed by the microprocessor 38. Because the copier employs an amount of toner supply which is predetermined in accordance with a sheet size or format, the microprocessor 38 functions to supply an amount of toner supplementary to the constant toner supply for each copy.

Figures 2, 2A, 2B:
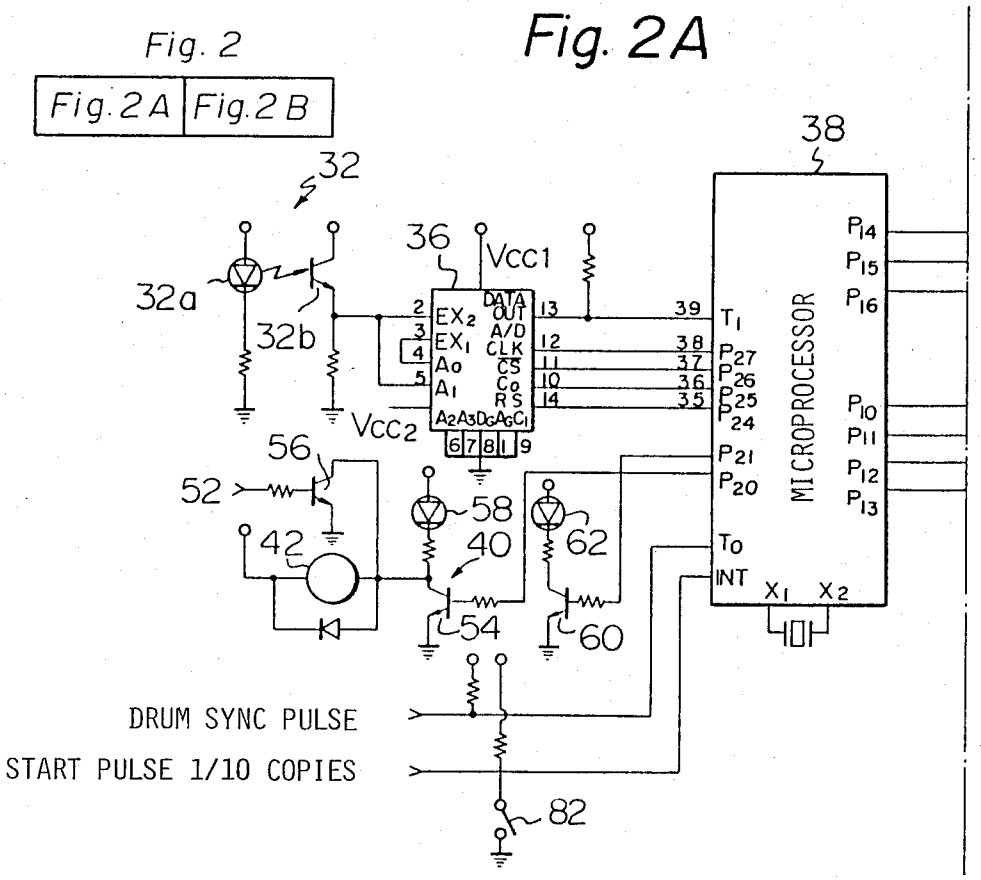
FIGS. 2, 2A, 2B are a circuit diagram showing electric connection between a microprocessor and an A/D converter included in the machine of FIG. 1.
Figure 2B:
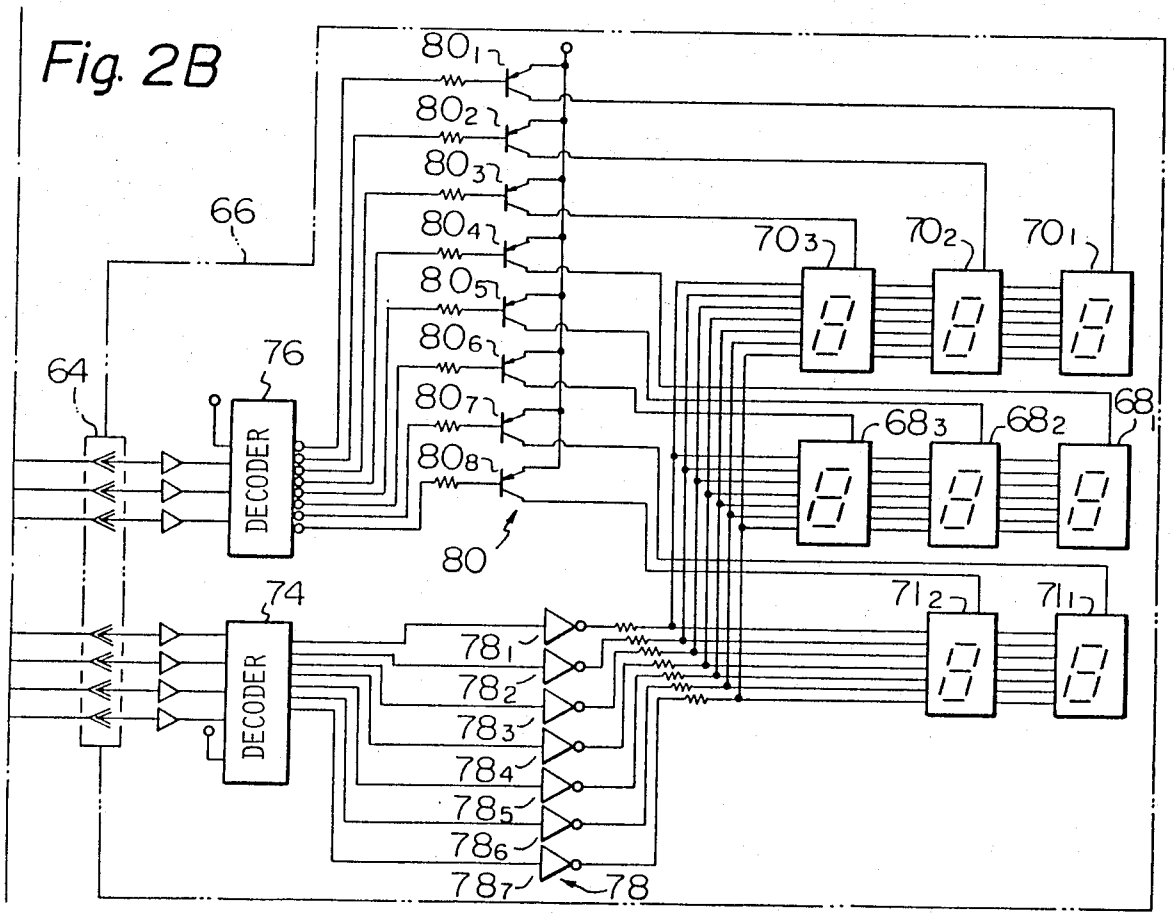

Referring to FIG. 2, the electric connection of the copier shown in FIG. 1 is illustrated in detail. The photosensor 32 comprises a light emitting diode or LED 32*a* and a phototransistor 32*b*. Light emitted from the LED 32*a* is reflected by the drum 12 and becomes incident on the phototransistor 32*b*. The emitter voltage of the phototransistor 32*b* is fed directly to an input channel $A_1$ of the A/D converter 36 (MB4025 manufactured by Fujitsu Limited, Japan) and, through voltage dividing terminals $EX_2$ and $EX_1$, to an input channel $A_0$. A digital (serial) data output terminal DATA OUT of the A/D converter 36 is connected to an interrupt terminal $T_1$ of the microprocessor 38, while control input terminals (A/D CLK-RS) thereof are connected to output ports P24–P27 of the microprocessor 38.

Figure 3:
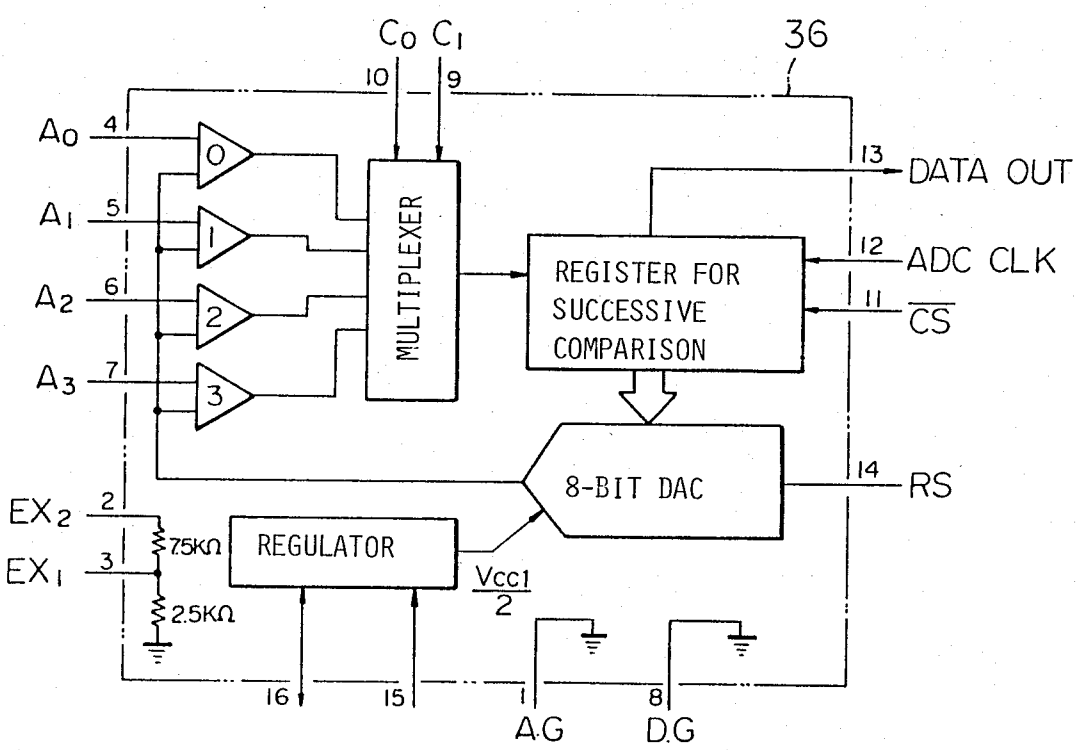
FIG. 3 is a block diagram showing details of the A/D converter indicated in FIG. 2.

The internal structure of the A/D converter 36 is shown in FIG. 3. The A/D converter 36 is of the 8-bit A/D conversion type which can be selectively supplied with input voltages $V_{cc}/2$ and $V_{cc}/8$ by range selection, while being capable of expanding the range to four times by range expansion. In a preliminary experiment, the toner density gave a voltage $V_{SG}$ of 4.0 V in a drum area corresponding to the white pattern $P_G$ (background level), and a voltage $V_{SP}$ of 1.6 V in a drum area corresponding to the black pattern $P_P$ (black level). For these voltage levels, the maximum voltage at the input channels $A_0$–$A_3$ is 2.5 V.

Based on the data mentioned above, a measurement range of 0–10 V obtained by range expansion, $V_{22}/2\times4$, is used for the background level $V_{SG}$ and that of 0–2.5 V, $V_{cc}/2$, for the black level $V_{SP}$. The emitter of the phototransistor 32*b* is connected to the terminal $EX_2$ of the A/D converter 36 while the terminal $EX_1$ is connected to the input channel $A_0$. Therefore, in A/D conversion with the input channel $A_0$ designated, the range is expanded four times as $2.5/(7.5+2.5)=\frac{1}{4}$; thus, the input channel $A_0$ is employed for the detection of the background level $V_{SG}$. The emitter of the phototransistor 32*b* is directly connected to the input channel $A_1$ and, therefore, the input channel $A_1$ is employed for the detection of the black level $V_{SP}$. It follows that the digitized data of the background level $V_{SG}$ multiplied by four lies in the same range as the A/D converted data of the black level $V_{SP}$. Under this condition, the relation between the digital output n and input voltage may be expressed as:

$$V_{SG}(n)=62+(n-1)\times39.126\ mV$$

$$V_{SP}(n)=17+(n-1)\times9.7756\ mV$$

For example, when the background level $V_{SG}(n)$ is 103 V, $V_{SG}$ (analog)$=62+102\times39.126$ mV$=3.991$ V; when the black level $V_{SP}(n)$ is 163 V, $V_{SP}$ (analog)$=17+162\times9.7756$ mV$=1.6006$ V.

We confirmed that the toner supply control employing the threshold value $V_{SP}=4V_{SG}$, i.e., $\frac{1}{4}$, is successful to maintain the contrast desirably high. In this embodiment, therefore, whether or not the toner supply is necessary is determined by comparing digital black pattern density data attained by coupling the density signal to the input channel $A_1$ and digital white pattern density data attained by coupling the density signal to the input channel $A_0$.

Referring again to FIG. 2, the solenoid driver 40 (FIG. 1) comprises a switching transistor 54 the base of which is connected to an output port $P_{20}$ of the microprocessor 38. The collector of the transistor 54 is connected to the clutch solenoid 42. When the logical level at the output port $P_{20}$ is made "1", the transistor 54 is turned on to energize the solenoid 42 so that the roller 44 (FIG. 1) associated with the hopper 46 is driven for rotation. A transistor 56 is connected to the solenoid 42 in order that a specific amount of toner supply matched to a copy size may be supplied for each copy. Thus, the toner will also be supplied when the transistor 56 is turned on under the control of the copy control microprocessor 52. While at least one of the transistors 54 and 56 is turned on, that is, during toner supply, a light emitting diode or LED 58 connected with one end of the solenoid 42 is turned on to display the toner supply. An output port $P_{21}$ of the microprocessor 38 is connected to the base of a transistor 60 which is in turn connected to a light emitting diode or LED 62 adapted for monitoring purpose. At a start of A/D conversion, the microprocessor 38 turns on the transistor 60 and thereby the monitor LED 62 and, after a predetermined operation for setting an amount of toner supply, it turns off the transistor 60 and thereby the monitor LED 62.

An interrupt terminal INT of the microprocessor 38 is supplied from the copy control microprocessor 52 with one pulse for each set of ten copies as a toner density control command, while a power source of the copier is turned on. An interrupt terminal $T_0$ of the microprocessor 38 is supplied with a train of pulses which occur one for each predetermined small angular movement of the drum 12. The microprocessor 38 controls the amount of toner supply by counting the pulses synchronous with the rotation of the drum 12, as will be described hereinafter. Further, output ports $P_{14}$–$P_{16}$ and $P_{10}$–$P_{13}$ of the microprocessor 38 are connected to a connector 64 with which a monitor unit 66 will be connected in the event of services for the copier.

The monitor unit 66 comprises a character display $68_1$–$68_3$ for displaying a white level $V_{SG}$, second character display $70_1$–$70_3$ for displaying a black level $V_{SP}$, third character display $72_1$, $72_2$ for displaying a density ratio $V_{SG}/V_{SP}$, segment docoder 74, digit coder 76, segment drivers $78_1$–$78_7$ and digit drivers $80_1$–$80_8$. When the monitor unit 66 is connected with the connector 64, transient values of $V_{SG}$, $V_{SP}$ and $V_{SG}/V_{SP}$ will appear on the unit 66. The circuitry additionally includes a toner density control command switch 82 which starts a toner density control when closed temporarily and will be closed in the event of services.

Figures 4, 4A:
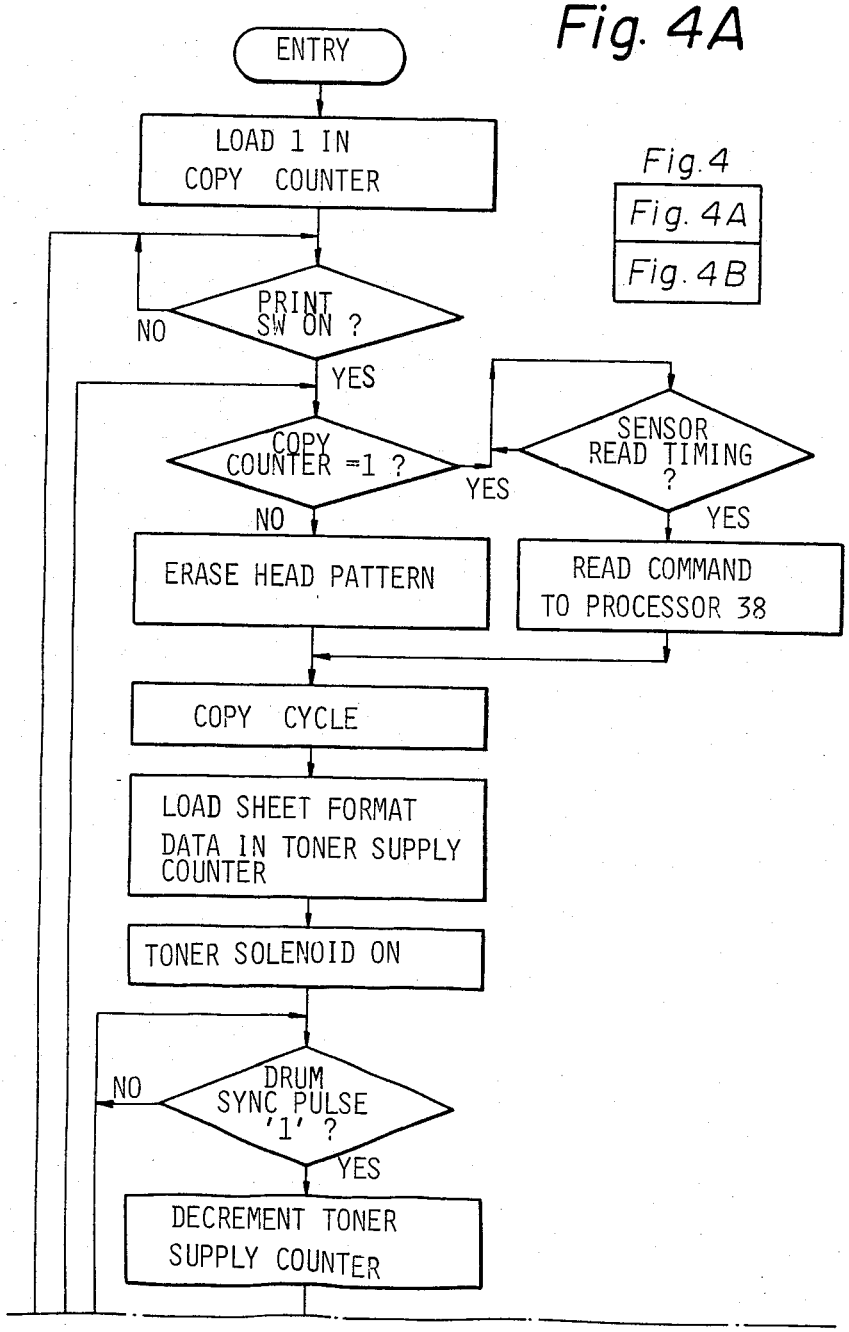
FIGS. 4, 4A, 4B are a demonstrating the operations of a copy control microprocessor for the control of constant amount toner supply and the control of toner density control command timing.
Figure 4B:
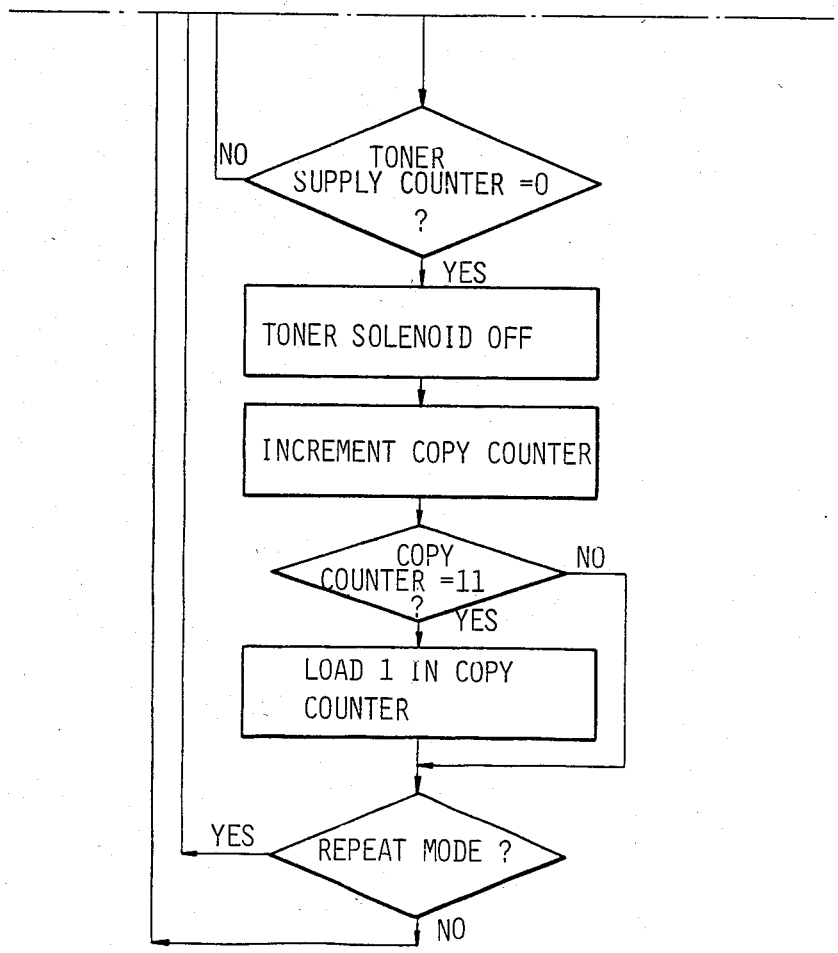

Referring to FIG. 4, a copy control flow of the microprocessor 52, particularly the constant amount toner supply, will be described. When various sections of the copier individually reach operable conditions, the microprocessor 52 loads "1" in a copy counter (program counter) which is adapted to provide a toner density control command timing. In this condition, the microprocessor 52 awaits closing of a print SW. As the print SW is closed (copy command), the charger 48 is energized to start exposure while the pulses synchronous with the drum rotation or drum sync pulses start to be counted. At the instant the pattern corresponding to the white pattern $P_G$ formed on the drum 12 reaches the sensor 32, the interrupt terminal INT of the microprocessor 38 is supplied with a toner density control command (start pulse). While the content of the copy counter is "2" to "10", the start pulse is not supplied and the erase lamp 50 is energized to discharge the drum surface over to the pattern corresponding to the black pattern $P_P$. Then, the copy control is continued. After one copy had been completed, a toner supplement counter (program counter) is loaded with sheet format data (toner supply time matched with a sheet format and number of pulses synchronous with the drum rotation). At the same time, the transistor 56 (FIG. 2) is turned on. Thereafter, every time a drum sync pulse arrives, the toner supplement counter is decremented by "1". Upon decrease of the count to "0", the transistor 56 is turned off. Then, the copy counter is incremented by "1". The microprocessor 52 starts another copying cycle in a repeat copy mode but awaits closing of the print switch SW in a single copy mode. Because the microprocessor 52 resets the copy counter to "1" each time its content reaches "11" and delivers a toner density control command to the microprocessor 38 only when the content of the copy counter is "1", a toner density control occurs once for ten successive copies.

The detection of toner densities of the patterns corresponding to the white and black patterns $P_G$ and $P_P$, ratio computation based on the detected toner densities and setting of a toner supply amount based on the computed ratio are commonly carried out by an interrupt control in response to a toner density control command pulse (start pulse) fed from the microprocessor 52 to the interrupt input terminal INT. The control of the set amount of toner supply and the display drive control for the displays $68_1$–$68_3$, $70_1$–$70_3$, $71_1$ and $71_2$ occur according to a main routine.

Figures 1, 5A:
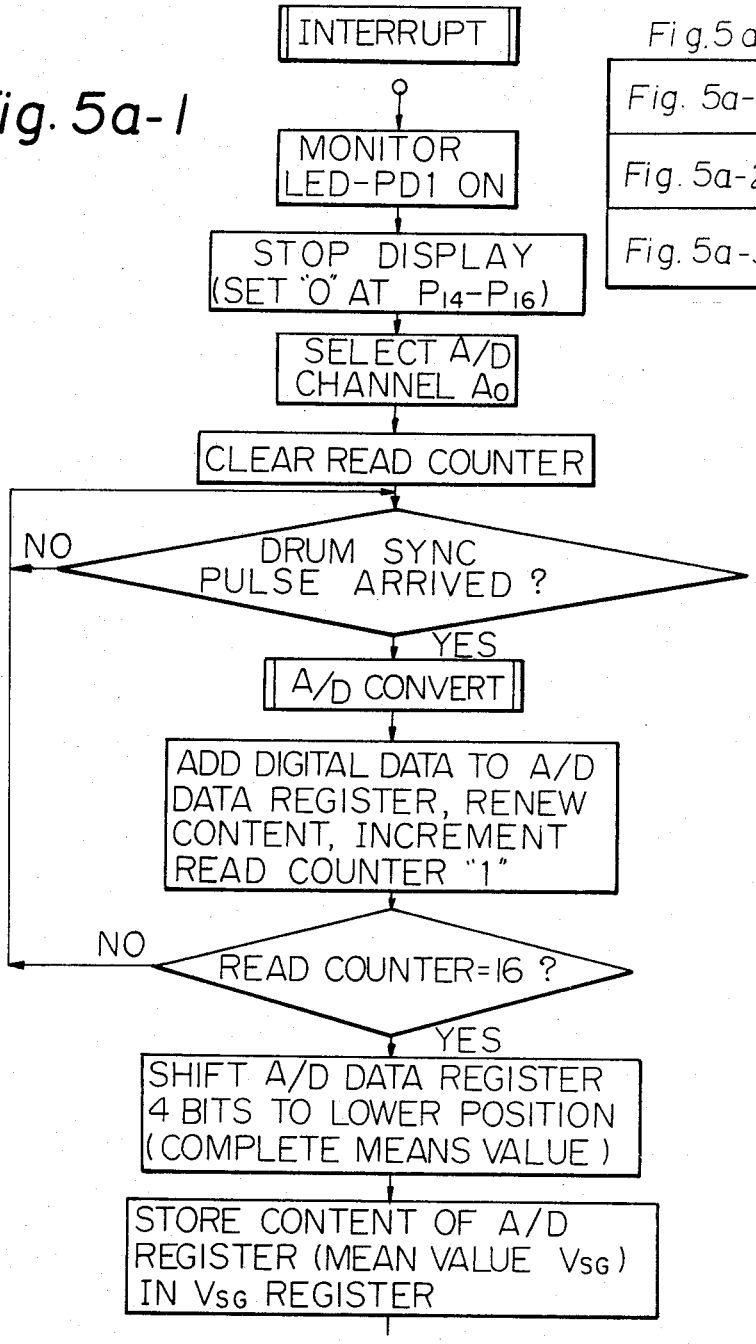
Figures 2, 5A:
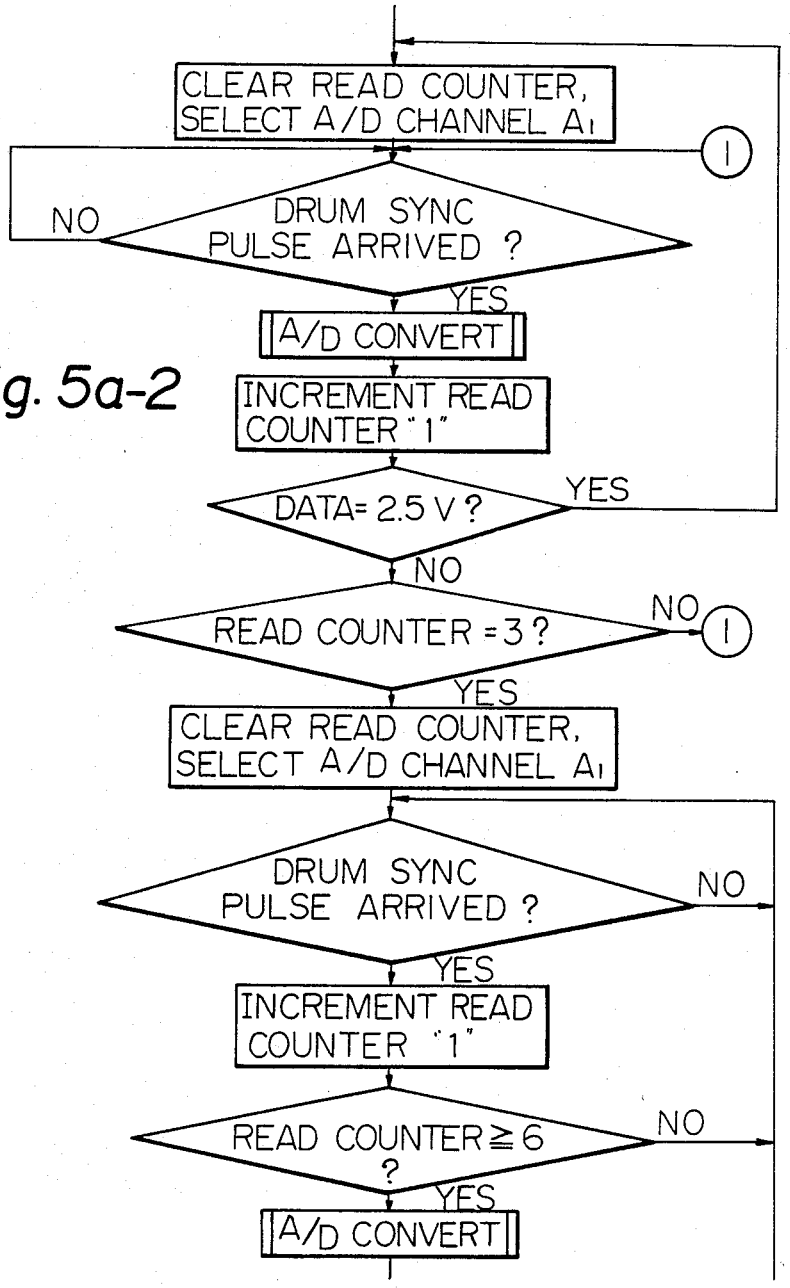

Referring to FIG. 5*a*, there is shown a flowchart which demonstrates the interrupt control. When the interrupt input terminal INT of the microprocessor 38 changes from logical "1" to logical "0", the microprocessor 38 makes its output port $P_{21}$ logical "1" to energize the LED 62 and loads a monitor counter (program counter) with "16". Then, the microprocessor 38 makes its output ports $P_{10}$–$P_{13}$ and $P_{14}$–$P_{16}$ logical "0" to turn off the indication on the displays $68_1$–$68_3$, $70_1$–$70_3$, $71_1$ and $71_2$, while specifying the input channel $A_0$ of the A/D converter 36.

Then, the microprocessor 38 clears a read counter and awaits the arrival of a drum sync pulse. In response to a drum sync pulse, the microprocessor 38 reads the digitized data (8 bits) serially at its port $T_1$ and stores them in addition mode in an A/D data register, by supplying data conversion timing pulses (A/D CLK) to the A/D converter 36. After 16 ($2^4$) times of repeated A/D conversion and addition of the data, the content of the A/D register is shifted 4 bits to a lower position. The resulting content of the A/D data register indicates a mean value of the data provided by $2^4$ times of A/D conversion. Because it is in response to the arrival of the toner image corresponding to the white pattern $P_G$ at the sensor 32 that the toner density control command pulse (start pulse) is fed to the interrupt input terminal INT, the digitized data associated with the specified input channel $A_0$ indicates a toner density of the white level ($V_{SG}$). The microprocessor 38 stores the mean value $V_{SG}$ of the white level toner density in a $V_{SG}$ register. Then, the microprocessor 38 clears the read counter for the detection of the border between the white toner pattern ($P_G$) and the black toner pattern ($P_P$), specifies the input channel $A_1$ for the A/D conversion, and performs A/D conversion in the same way in response to a drum sync pulse. As already described, the input channel $A_1$ is directly supplied with a voltage indicative of a detected toner density (without voltage division), the maximum value of the input analog voltage is 2.5 V, the voltage (analog) indicating a toner density of the white pattern is not lower than 2.5 V, and the voltage indicating a toner density of the black pattern is lower than 2.5 V. For these reasons, whether the pattern is white or black can be identified by checking whether the input voltage at the input channel $A_1$ is not lower than 2.5 V (the digital data will be 2.5 V when the input voltage is not lower than 2.5 V, because the voltage is 2.5 V in full scale). Accordingly, as long as the digital data indicates 2.5 V, the microprocessor 38 determines that the sensor 32 is still detecting the white pattern and, so, repeats another A/D conversion. As the digital data indicates a voltage lower than 2.5 V, the microprocessor 38 increments the read counter by "1" and carries out A/D conversion in response to a drum sync pulse. When successive three times of A/D conversion have shown voltages lower than 2.5 V (when the read counter has decremented to "0"), the microprocessor 38 determines that the toner image of the black pattern has been brought into the detectable range of the sensor 32, specifies the input channel $A_1$ of the A/D converter 36 and clears the counter. Thereafter, the microprocessor 38 waits for 5 successive drum sync pulses to avoid detection of a transitional range. It will be noted that, if the digitized data indicates 2.5 V even once during (m−1) times of repeated A/D conversion after it has indicated a voltage lower than 2.5 V, the microprocessor 38 loads the read counter with "3" again and repeats A/D conversion until the data continuously indicates voltages lower than 2.5 V for another three times of A/D conversion.

As the counter reaches "6", the microprocessor 38 performs A/D conversion. Thereafter, the microprocessor carries out A/D conversion in response to every drum sync pulse and adds $2^4$ times of digitized data in an A/D data register. Upon completion of the $2^4$ times of conversion and summation of the data, the microprocessor 38 shifts the content of the A/D data register by 4 bits to a lower position. The resulting content of the A/D data register indicates a mean value $V_{SP}$ of the detected input voltages ($V_{SP}$). At this stage of operation, $V_{SG}$ shows a value which is $\frac{1}{4}$ the mean value of 16 times of sampling of the white level, while $V_{SP}$ shows a mean value of 16 times of sampling of the black level. Here, the microprocessor 38 compares the densities $V_{SP}$ and $V_{SG}$ and, if the contrast is low ($V_{SP}>V_{SG}\rightarrow$YES), loads toner counters (registers) 1 and 2 with a predetermined value. Because the supply of about 1 gram of toner corresponds to a time period for which 1.792 pulses are counted, a time period to energize the solenoid 42 is expressed as $k\times1792=k\times7\times2^8$ where k is an amount of toner supplied at a time. Therefore, the microprocessor 38 stores $k\times7\times2^8$ in the toner counter (register) 1 which covers lower eight bits and the toner counter (register) 2 which covers upper eight bits. This is attained by storing "0" in all the lower eight bits of the toner counter 1 while storing the binary data which represents $k\times7$ in the toner counter 2 for the upper eight bits. After storing in the toner counters 1 and 2 the toner supply time (count of drum sync pulses), the microprocessor 38 sets the output port P20 to logical "1" to energize the solenoid 42 and, then, returns to the main routine (FIG. 5*b*).

Figures 2, 5B:
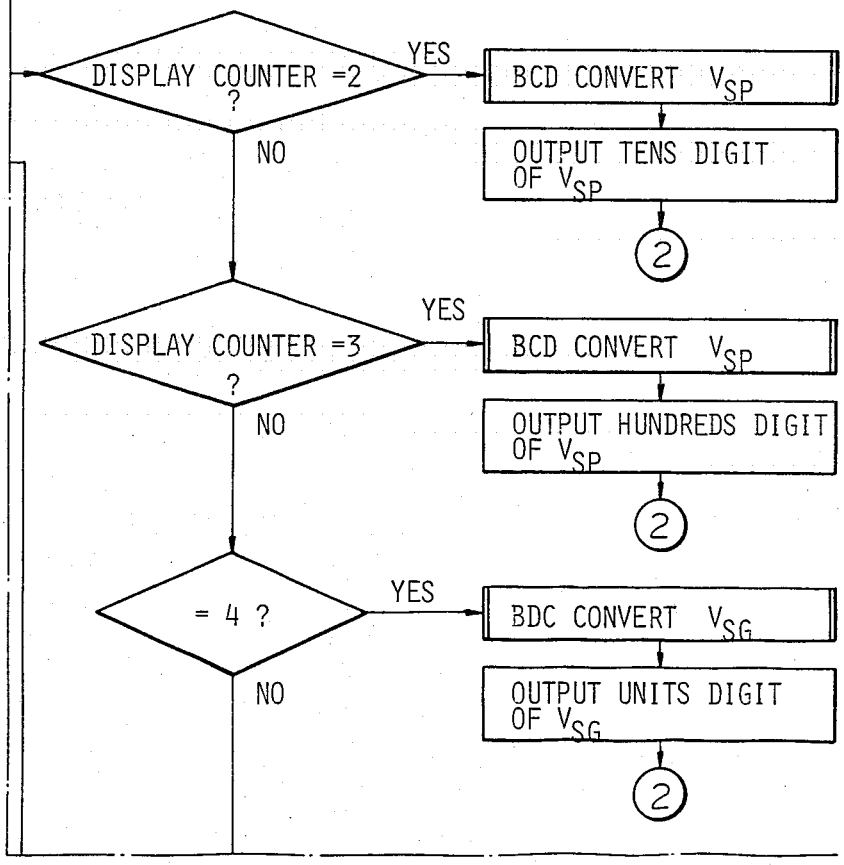
Figures 3, 5B:
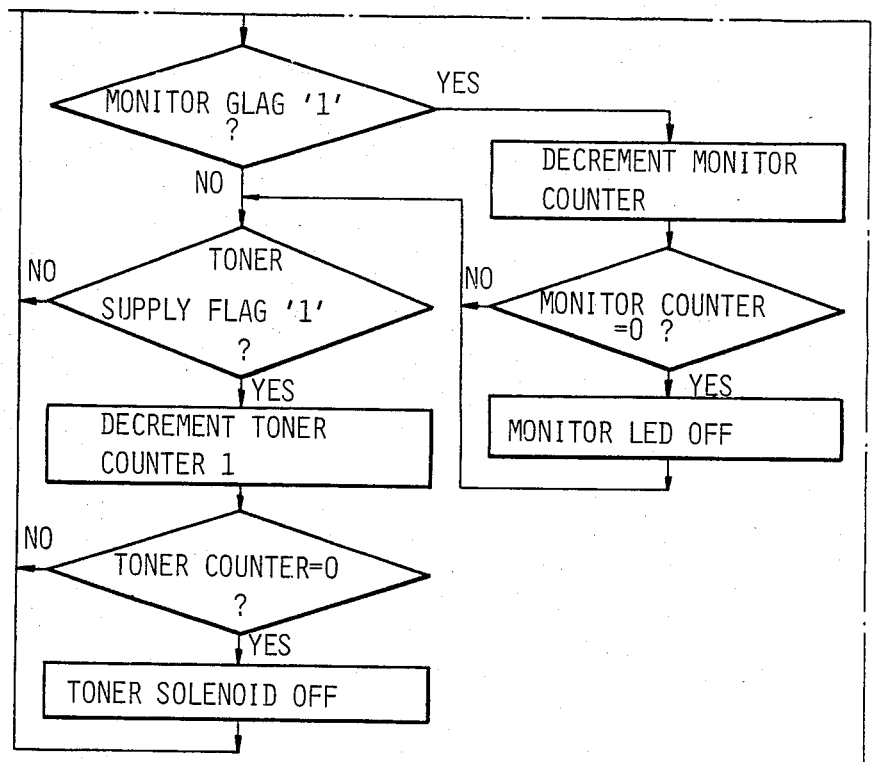
Figures 4, 5B:
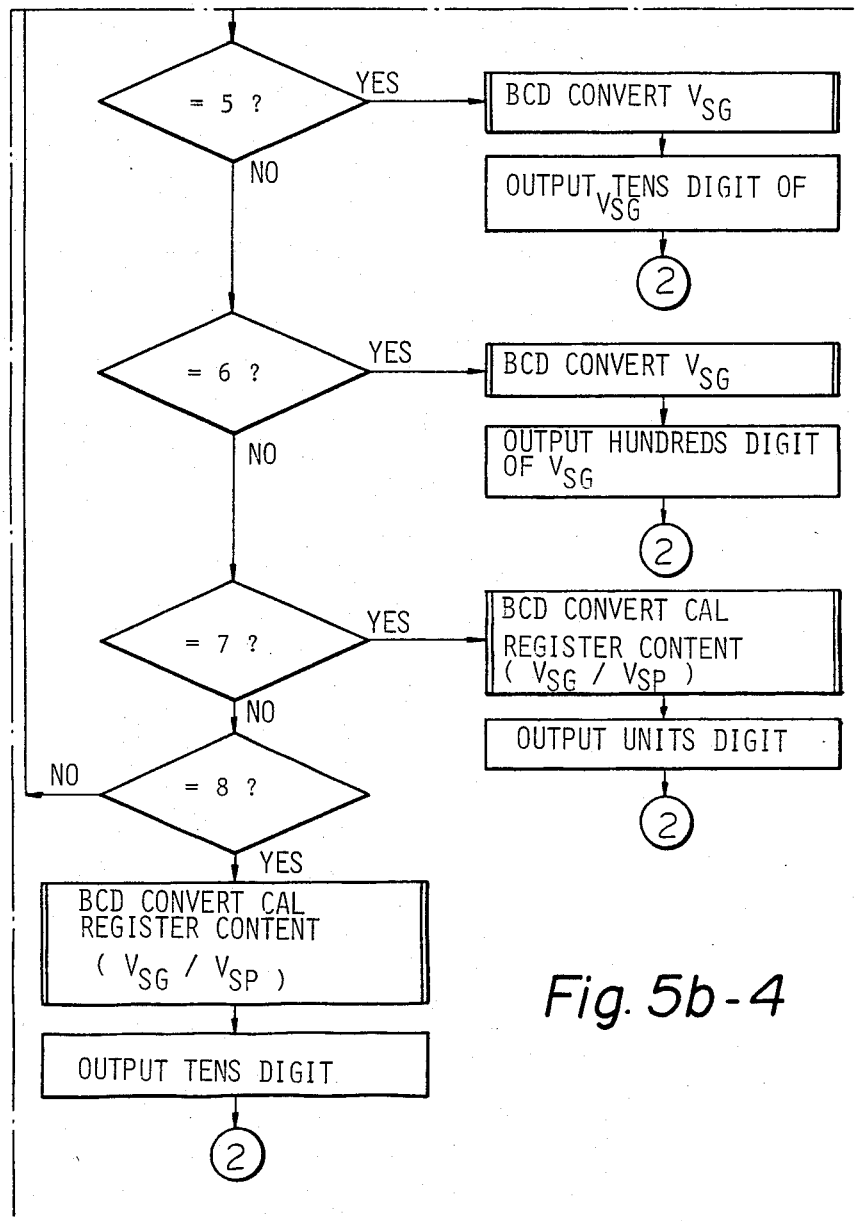

Referring to FIG. 5*b* which shows the main routine, the microprocessor 38 performs a display drive control which causes the displays $70_1$–$70_3$, $68_1$–$68_3$, $71_1$ and $71_2$ to emit light sequentially on a time sharing basis, as long as the signal level at the port $T_0$ (pulse synchronous with the drum rotation) remains logical "0". As the signal at the port $T_0$ changes from logical "0" to logical "1", the microprocessor 38 increments a key counter (program counter) by "1" and energizes one display (one position). This procedure is repeated while the signal at the port $T_0$ remains logical "1". After $\alpha$ times of repetition, the microprocessor 38 determines that the port $T_0$ has been logical "1" for that period and a drum sync pulse has arrived. Then, the microprocessor 38 sets a key end flag to logical "1" indicative of the arrival of such a pulse, decrements the monitor counter by "1" if a flag indicative of energization of the monitor LED 62 is logical "1", and deenergizes the LED 62 as the content of the monitor counter decreases to "0". As described with reference to FIG. 5*a*, when the microprocessor 38 is supplied with a toner density control command pulse from the microprocessor 52, "16" is set in the monitor counter with the LED 62 turned on and the operation advances to the main routine (FIG. 5*b*) after the procedure from the density detection to the setting of a toner supply time. For this reason and because the monitor counter is decremented in response to each drum sync pulse in the main flow of FIG. 5*b*, the LED 62 is turned off upon generation of 16 drum sync pulses after the completion of the interrupt procedure shown in FIG. 5*a*.

After setting the key end flag to logical "1", the microprocessor 38 refers to a toner supply flag and, if it is logical "1" indicating that the solenoid 42 has been energized, decrements the toner counter (1, 2). As the toner counter is decremented to "0", the microprocessor 38 turns off the solenoid 42. When the content of the toner counter is not "0", the microprocessor 38 waits until the signal level at the port $T_0$ becomes logical "0" while performing the display drive control for this period of time. In response to a change of the signal level at the port $T_0$ to logical "0", the microprocessor 38 clears the key end flag and key counter determining that one drum sync pulse has terminated and, then, awaits a change of the signal level at the port $T_0$ to logical "1" while energizing the displays. In this manner, the microprocessor 38 decrements the toner counter (1, 2) every time a drum rotation synchronous pulse arrives; upon decrease of the content of the toner counter to "0", that is, upon the lapse of a toner supply time after the toner supply time has been set and the solenoid 42 has been turned on, the microprocessor 38 turns off the solenoid 42. Thereafter, the microprocessor 38 effects the display drive control only.

Figure 6:
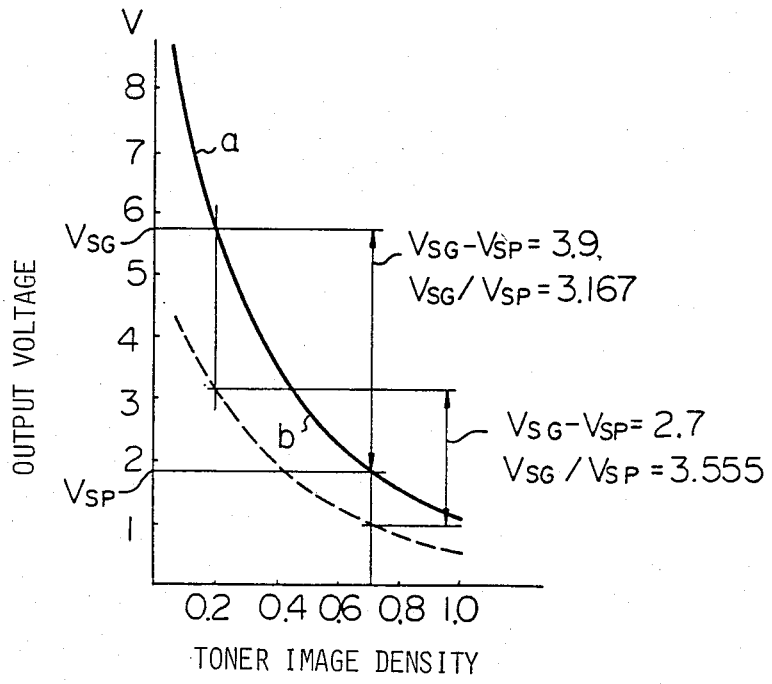
FIG. 6 is a graph showing a relationship between output voltages of a toner density sensor and toner image densities.

Thus, the embodiment described above utilizes the fact that the voltage generated by the toner image corresponding to the white pattern area is about 4 V and that generated by the toner image corresponding to the black pattern area is about 1.7 V which greatly differs from 4 V, and the fact that the A/D converter 36 receives a voltage which is 2.5 V at the maximum while delivering digital data which constantly indicates 2.5 V as long as the input voltage is not lower than 2.5 V. After detection of the toner image density in the white pattern area, the operation advances to the detection of a toner image density corresponding to the black pattern when the output data of the A/D converter 36 has indicated a voltage lower than 2.5 V and such a voltage has continued throughout the subsequent three times of detection, determining that the black pattern on the drum has reached the sensor 32. This permits the pattern density detection timing to be readily set; only the read timing for the white or first pattern should be set. It is thus needless to set any another timing even if the magnification is changed. Because an amount of toner supply is determined on the basis of the density ratio $V_{SG}$ between the toner images corresponding to the white and black patterns, the toner density control can occur relatively stably though the characteristics of the sensor and/or drum surface may fluctuate. As shown in FIG. 6, suppose that the output voltages of the sensor 32 sensing an image density has shifted from the standard values indicated by a solid curve to the values indicated by a dotted curve, due to a change in the characteristics of the sensor 32 and/or drum surface. Then, the difference between the voltages $V_{SG}$ and $V_{SP}$ associated with the white and black toner patterns changes from 3.9 V to 2.7 V, resulting in a change of $(3.9-2.7)/3.9\times100=31\%$. Still, the ratio $V_{SG}/V_{SP}$ increases from 3.167 to 3.555 and the change is not more than $(3.555-3.167)/3.167\times100=12.3\%$. Thus, the stability in toner density control is not effected by any change in the characteristics of the sensor and/or drum.

Furthermore, in the embodiment described, the resolution in A/D conversion of the voltage $V_{SP}$ corresponding to the black toner pattern is selected to be four times the resolution of the voltage $V_{SG}$ corresponding to the white toner pattern. As well known in the art, a developed toner image often involves white omitted spots and black spots which result in an irregular distribution of detected voltage levels though representing the same pattern. The absolute value of such fluctuation is large at $V_{SG}$ and small at $V_{SP}$. Thus, where different resolutions are assigned to different patterns and the input voltage levels for A/D conversion are made substantially the same as previously described, there can be prevented an occurrence that the fluctuation of one of the detection levels becomes predominant relative to the other. Particularly, in the case of A/D conversion, a common resolution would reduce the weight of $V_{SP}$ relative to $V_{SG}$ unless with a larger number of A/D data bits, due to the substantial range which includes $V_{SG}$ and $V_{SP}$. The number of A/D data bits should be as small as possible from the viewpoint of element construction and calculation. It will thus be apparent that assigning different resolutions to different patterns minimizes the number of A/D data bits and simplifies the element construction and calculation accordingly. Additionally, whether or not to supply the toner is determined relying not on division but on simple comparison in magnitude, promoting simple computation as well as fast determination.

Figure 7:
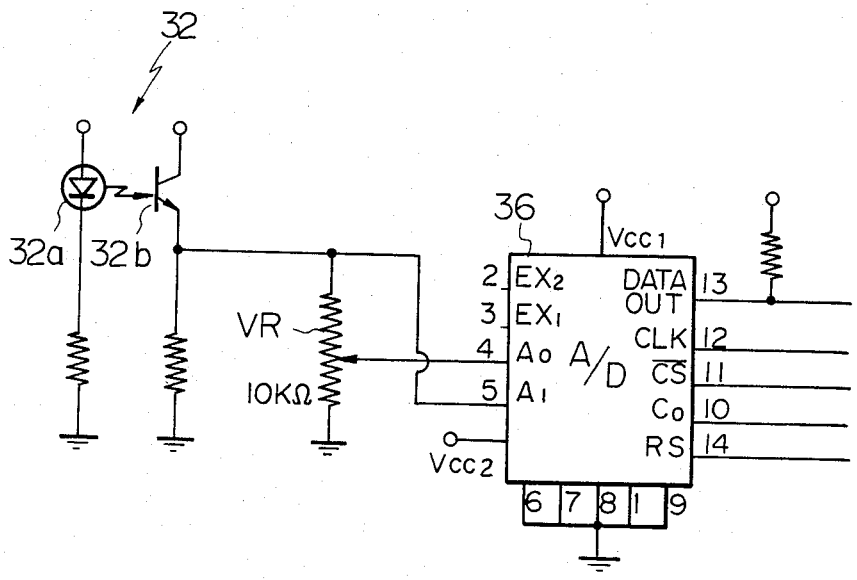
FIG. 7 is a circuit diagram of an A/D converter applicable to another embodiment of the present invention.

Other embodiments and modifications of the present invention will be described. Whether or not to supply the toner has been described as being determined by comparing digitized data of analog voltages $V_{SP}$ and $V_{SG}$ with respect to a threshold value of $V_{SP}/V_{SG}=4/1$ and ranges of 1:4. Alternatively, the ranges may be designed adjustable to make the threshold value controllable. This is achievable in conjunction with the A/D converter 36 of FIG. 3 by directly coupling the analog density signals to the input terminal $A_1$ and coupling a voltage (divided voltage) of the slider of a 10 kΩ variable resistor VR to the input terminal $A_0$, as illustrated in FIG. 7.

While in the embodiment shown and described the black and white charge patterns have been formed by scanning the optical marks $MR_P$ and $MR_G$ carried by the glass platen 10, they may be formed through the control over energization of the charger 48, ON/OFF control of a light source for illumination, ON/OFF control of the erase lamp 50 or control of the bias voltage applied to the developing roller 24.

The value associated with an image density has been shown and described as a density of the toner image of each charge pattern (black or white). Instead, the value concerned may be achieved by detecting a surface potential of a charge pattern before development or a surface potential of a toner image of the charge pattern after development, or detecting a density of a toner image transferred onto a sheet of paper.

Furthermore, the embodiment described has been constructed to maintain image density constant by determining an amount of toner supply on the basis of a ratio between the values associated with image densities of two different patterns. Alternatively, the ratio mentioned above may be used to control the charger 48, intensity of illumination, bias voltage for development, toner supply to a developer, toner supply to the developing station or transfer potential, either independently or in combination. In any case, the value associated with an image density differs a great deal from one pattern to the other and fluctuates with time, temperature or the like. Thus, for a more stable image density control, the values corresponding to different patterns should be A/D converted with different resolutions so that the parameter associated with image densities may be controlled by an amount which is based on the ratio between the digital values.

Various modifications will become possible for those skilled in the art after receiving the teachings of the present disclosure without departing from the scope thereof.

What is claimed is:

1. A method of controlling an image density in electrophotography by controlling at least one of various image density parameters in response to values detected from different pattern areas, the image density parameters including an amount of charge deposited on a photoconductive element by a charger, bias voltage for development, toner concentration in a developer, rate at which toner is supplied to the developing unit and image transfer potential, comprising the steps of:

(a) forming at least two pattern areas having different potentials on the surface of the photoconductive element by at least one of various means for forming charge patterns which include controlling the energization of the charger, controlling an illuminating lamp and projecting an image pattern;

(b) producing in digitized form in different ranges respectively assigned to the two pattern areas, at least one of values associated with an image density which include a surface potential of the pattern area before development, toner density of the pattern area after development, surface potential of the pattern area after development and image density of an area of a transferred image which corresponds to the pattern area;

(c) comparing the digitized data of the different patterns and, based on the result of the comparison, setting up correspondence of the values associated with image density to a relation in magnitude between the digitized data and;

(d) controlling said at least one image density parameter in accordance with a predetermined function based on the result of said comparison performed in step (c).

2. A method as claimed in claim 1, in which the charge patterns are formed by projecting black and white image patterns having a substantial density difference onto the surface of the photoconductive element.

3. A method as claimed in claim 1, in which the value associated with image density is a toner density on the surface of the photoconductive element, said toner density being sensed by a photosensor.

4. A method as claimed in claim 3, in which the image density parameter is a rate at which toner is supplied to a developing station.

* * * * *